US007226511B2

(12) United States Patent
Rein et al.

(10) Patent No.: US 7,226,511 B2
(45) Date of Patent: Jun. 5, 2007

(54) DIRECT PRODUCTION OF WHITE SUGAR FROM SUGARCANE JUICE OR SUGAR BEET JUICE

(75) Inventors: Peter W. Rein, Baton Rouge, LA (US); Luis R. S. M. Bento, Baton Rouge, LA (US); Bruce M. Ellis, Houston, TX (US)

(73) Assignee: Board of Supervisors of Louisiana State University And Agricultural and Mechanical College, Baton Rouge, LA (US)

( * ) Notice: Subject to any disclaimer, the term of this patent is extended or adjusted under 35 U.S.C. 154(b) by 114 days.

(21) Appl. No.: 11/260,069

(22) Filed: Oct. 26, 2005

(65) Prior Publication Data

US 2006/0090749 A1 May 4, 2006

Related U.S. Application Data

(60) Provisional application No. 60/623,692, filed on Oct. 29, 2004.

(51) Int. Cl.
*C13D 3/08* (2006.01)
*C13D 3/12* (2006.01)
*C13D 3/14* (2006.01)

(52) U.S. Cl. ..... 127/46.2

(58) Field of Classification Search ..... 127/46.2
See application file for complete search history.

(56) References Cited

U.S. PATENT DOCUMENTS

| | | | | |
|---|---|---|---|---|
| 5,554,227 | A | 9/1996 | Kwok et al. | 127/58 |
| 5,893,947 | A * | 4/1999 | Pease et al. | 127/46.2 |
| 6,228,178 | B1 | 5/2001 | Saska | 127/42 |
| 6,368,413 | B1 * | 4/2002 | Charlet et al. | 127/46.1 |
| 6,485,574 | B1 * | 11/2002 | Chou et al. | 127/46.2 |
| 6,942,805 | B2 * | 9/2005 | Soest et al. | 210/660 |

FOREIGN PATENT DOCUMENTS

WO WO / 00/60128 10/2000

OTHER PUBLICATIONS

S. Davis (2001), no month provided "The Chemistry of Colour Removal: A Processing Perspective," Proc. S. Afr. Sug. Tech. Assoc. 75:328-336.

* cited by examiner

*Primary Examiner*—David M. Brunsman
(74) *Attorney, Agent, or Firm*—John H. Runnels; Bonnie J. Davis

(57) ABSTRACT

An economical process is disclosed for the direct production of white sugar from clarified juice. Juice from a cane sugar mill, or sugar beet juice, is first contacted with hydrogen peroxide, before passing through granular activated carbon. The juice is then passed through cationic and anionic resins to remove inorganic compounds, colorants, and other impurities. Then the juice may be concentrated and sugar crystallized. White sugar is produced directly, without the need for an intermediate raw sugar crystallization.

24 Claims, 2 Drawing Sheets

DIRECT PRODUCTION OF WHITE SUGAR FROM SUGARCANE JUICE OR SUGAR BEET JUICE

The benefit of the Oct. 29, 2004 filing date of U.S. provisional patent application Ser. No. 60/623,692 is claimed under 35 U.S.C. § 119(e). The complete disclosure of the priority provisional application is hereby incorporated by reference.

This invention pertains to the direct production of white sugar from sugarcane juice or sugar beet juice. Although the description below refers primarily to production from sugarcane juice, the method of this invention may also be used in the production of white sugar from sugar beet juice.

Sugar cane juice contains sucrose and other components. Refined white cane sugar is primarily sucrose, with most polysaccharides and other non-sucrose compounds removed. The color of refined sugar should be less than about 45 ICUMSA units ("IU," a standard measure of color in the sugar industry). In the conventional method of producing refined cane sugar, initially a raw sugar is produced at the mill by crystallization from cane juice, with only rudimentary clarification. In addition to sucrose, raw sugar typically includes invert sugars, polysaccharides, ash, and other compounds, and has a color in the range of 1,000 to 5,000 IU. It is generally light brown in appearance. The raw sugar is later refined, usually at an off-site refinery. The raw sugar is washed or affined; "melted" (i.e., dissolved in hot water); and then clarified to remove color and suspended solids. Conventional clarification is usually performed by liming, carbonatation, and phosphatation. The clarified syrup is decolorized, typically by adsorption of impurities onto activated carbon, bone char, or ion exchange resins. A conventionally decolorized syrup should have no more than 800 IU color for successful refining to white sugar having a color below 45 IU; preferably below 25 IU. Traditional refining methods suffer from high energy costs, high chemical reagent costs, and high waste disposal costs.

Impurities in the juice primarily end up in the molasses stream, a low value by-product of crystallization. Molasses also contains some dissolved sugar that cannot be crystallized through conventional means, and thus represents a loss of sugar in processing. The amount of molasses produced depends primarily on the concentration of impurities in the raw juice from the extraction plant.

Some prior processes have been reported for purifying raw juice to produce raw sugar, or to separate impurities and color compounds from syrup to allow white sugar to be crystallized directly. None of these prior processes has been implemented on a commercial scale, however, presumably because they would not be economical. To the inventors' knowledge, all prior processes for the direct production of white sugar have been based on membrane separation, which is costly. Membrane separations require considerable pumping effort, and have significant capital and operating costs. In addition, the retentate stream, that which does not pass through the membrane, must be treated separately to recover the sugar still in it, before it is discharged as a waste stream.

U.S. Pat. No. 6,228,178 describes a process for producing white sugar with nano-filtration membranes. These membranes have very small pores, and therefore remove a high proportion of impurities from the juice. However, the flow through the membranes is slow because of the small pore size, requiring large membrane surfaces and significant pumping, capital, and operating costs. Because dissolved inorganic impurities are not removed by filtration, the quantity of molasses produced and the resulting sugar loss in molasses are little affected.

U.S. Pat. No. 5,554,227 describes a process for manufacturing crystalline sugar from an aqueous sugar juice such as cane juice or sugar beet juice, employing the chromatographic separation of sucrose from other components in the syrup. Because some of these components have similar molecular size and structure, a two-step process must generally be employed to adequately separate sucrose from other components. In addition, calcium ions in the juice must be removed before the chromatographic separation so that they do not interfere with the separation process. Removal of calcium is typically accomplished by an ion exchange softening process before the chromatographic separation. Because the sucrose is effectively separated from the impurities, the loss of sugar in molasses is largely eliminated, and sugar conforming to white sugar standards can be produced. See also U.S. Pat. No. 5,468,300.

International patent application WO 00/60128 describes a process employing two stages of ion exchange following membrane separation. The first stage, using a strong acid cationic resin, removes cations from the juice. The low pH requires cooling the juice to a low temperature, about 10° C., to prevent loss of sucrose due to acid inversion. Then follows a weak base anion exchange to remove anions. The bulk of the inorganic species and a large proportion of color compounds are removed by the ion exchange steps. However, further decolorization is required, using a strong anion exchange in chloride form to reduce the color sufficiently that white sugar may be crystallized. As a large proportion of the impurities is removed by these steps, the amount of molasses and hence the loss of sugar in molasses are substantially reduced.

S. Davis (2001), "The Chemistry of Colour Removal: A Processing Perspective," *Proc. S. Afr. Sug. Tech. Assoc.* 75:328-336 presents a review of techniques that have been used in refining to remove color to produce white sugars. Table 3 on p. 334 hypothesized (with no supporting data mentioned) that the combination of an oxidation step and an activated carbon step might be beneficial; but that the combination of an oxidation step and an ion exchange step is a "combination that is not ideal, and should preferably be avoided." At page 332, the author noted that from "the work surveyed, it seems essential to follow oxidation with carbonatation or phosphatation . . . ."

We have discovered an economical process for the direct production of white sugar from clarified juice. Juice from a cane sugar mill, or sugar beet juice, is first contacted with an oxidizing agent such as hydrogen peroxide or ozone, preferably hydrogen peroxide, before passing through granular activated carbon (GAC). After passage through GAC, the juice is passed through cationic and anionic resins to remove inorganic compounds, colorants, and other impurities. Then the juice may be concentrated and sugar crystallized, for example using means that are otherwise conventional in the art at this stage. White sugar is produced directly, without the need for an intermediate raw sugar crystallization. It is not necessary to employ membrane filtration, carbonatation, or phosphatation at any step of the process in order to obtain excellent results.

In initial experiments, treatment with hydrogen peroxide and activated carbon alone did not reduce color and ash sufficiently to be commercially attractive. We then ran the treated juice through ion exchange columns. We were concerned that the ion exchange columns would become irreversibly fouled. We discovered that adding the ion exchange columns to the process reduced the color and ash of the juice substantially, without the need for a membrane filtration step. (Previous decolorization processes that employ ion exchange columns have required membrane filtration.) We also discovered that the ion exchange resins were not irreversibly fouled, and that they could readily be regenerated through ordinary means. If the ion exchange resins had become irreversibly fouled and could not be regenerated, the process would not be economical.

In a typical embodiment, cane sugar juice is initially extracted, and then clarified by heating and treatment with calcium hydroxide, following conventional procedures. The resulting clarified juice has a color of about 15,000 ICUMSA units (IU).

In the first step of the novel process the clarified juice, at a temperature between about 75° C. and about 99° C., is contacted with hydrogen peroxide or other oxidant, preferably for about 5 to about 30 minutes, at a pH between about 6.0. and about 8.5. The oxidizing agent preferably comprises between about 0.05% and about 0.5%, by weight, of the weight of the dissolved solids in the juice, more preferably between about 0.1% and about 0.3%.

In the second step, the juice is passed through granular activated carbon columns. After this step, the color of the juice is reduced to about 2,000 IU.

In the third step, the juice is passed over ion exchange resins, for both demineralization (or softening) and decolorization. Optionally, the juice may pass through separate anionic resin and cationic resin beds, or mixed beds containing both anionic and cationic resins. For demineralization, the juice is preferably cooled to a temperature between about 8° C. and about 12° C., preferably about 10° C., prior to ion exchange processes to inhibit inversion reactions that convert sucrose into other sugars. In a preferred embodiment, the juice after ion exchange is heated by the juice being cooled, to enhance energy efficiency.

In the fourth step the juice, which now has a color below about 1000 IU, passes to the evaporation stage for crystallization. The quality of the juice resulting from this purification process is such that white sugar, with a color below about 45 IU, preferably below about 25 IU, may then be produced directly, following otherwise conventional sugar crystallization procedures. Note that white sugar having low color is directly produced, without the need for an intermediate raw sugar step. No membrane filtration step is required, nor a carbonatation step, nor a phosphatation step. Following the ion exchange step, water may be evaporated from the juice to form a syrup with a concentration of about 60 to about 68%, by weight, of soluble solids; the syrup may then be clarified, and white sugar may then be crystallized from the syrup using otherwise conventional means.

The process reduces the concentration of color compounds by at least 50%, preferably by at least 60%, more preferably by at least 70%, more preferably still by at least 80%, and most preferably by at least 90%. The process reduces the concentration of divalent cations in the juice (primarily calcium and magnesium ions) by at least 75%.

The granular activated carbon (GAC) may be placed in fixed bed or pulsed bed columns. Juice may flow through the GAC bed in a down-flow or up-flow direction. A set of two or more GAC columns in parallel or in series may be used. In a preferred embodiment, the first GAC column in a series is a small "guard" column that filters suspended solids from the juice, thereby protecting subsequent GAC columns from fouling. In a pulsed bed configuration, there may be less need for a "guard" column.

The final treated juice may be concentrated, clarified, and crystallized in an otherwise conventional manner, for example with a flotation clarifier, a vacuum pan crystallizer, and a centrifuge. Because calcium and other species that tend to foul evaporator surfaces are removed by the novel process, evaporator fouling is greatly reduced or even eliminated.

The quantity of molasses produced from the final stage of crystallization is much reduced as compared to that resulting from conventional sugar production, and it has a higher value as a fermentation feedstock because it has lower levels of impurities. The novel process allows higher recovery of sugar, and the production of a better quality molasses with enhanced value.

Our results have shown that juice that has been treated with GAC does not foul ion exchange resins (or fouls them only very slowly). The resins continue to perform as well over time as do ion exchange columns used for processing membrane-filtered juice.

The novel process may be implemented in raw cane sugar mills. No prior process allows the direct production of white sugar in an economically viable manner at cane sugar mills. Based on testing at one raw cane sugar mill in Louisiana, the net recovery of sucrose as white sugar was about 88%, compared to about 80% for conventional milling and refining.

Figure 1:
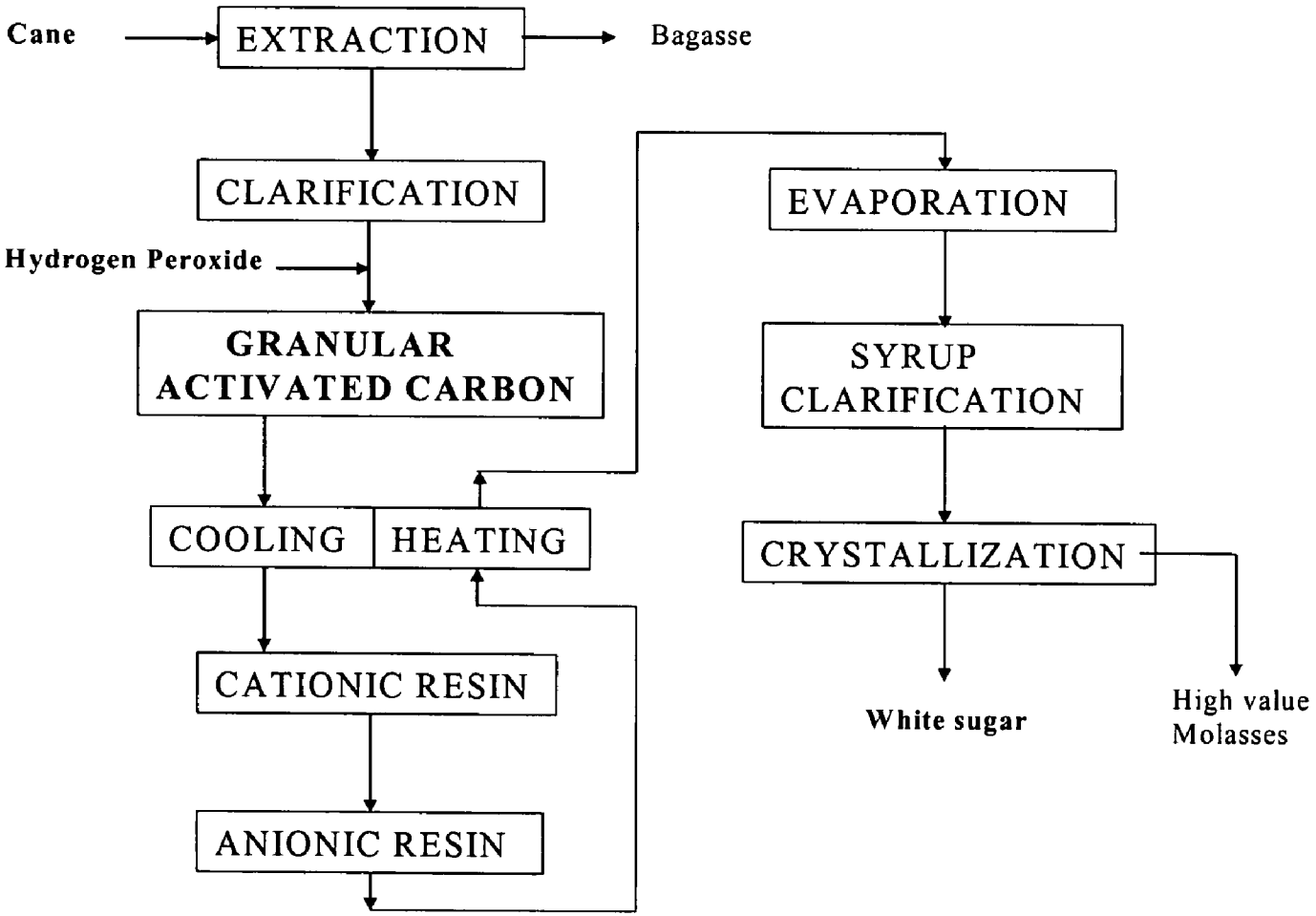
FIG. 1 illustrates schematically one embodiment of the invention, using hydrogen peroxide, GAC, and demineralization to produce while sugar and high value molasses from sugar cane.
Figure 2:
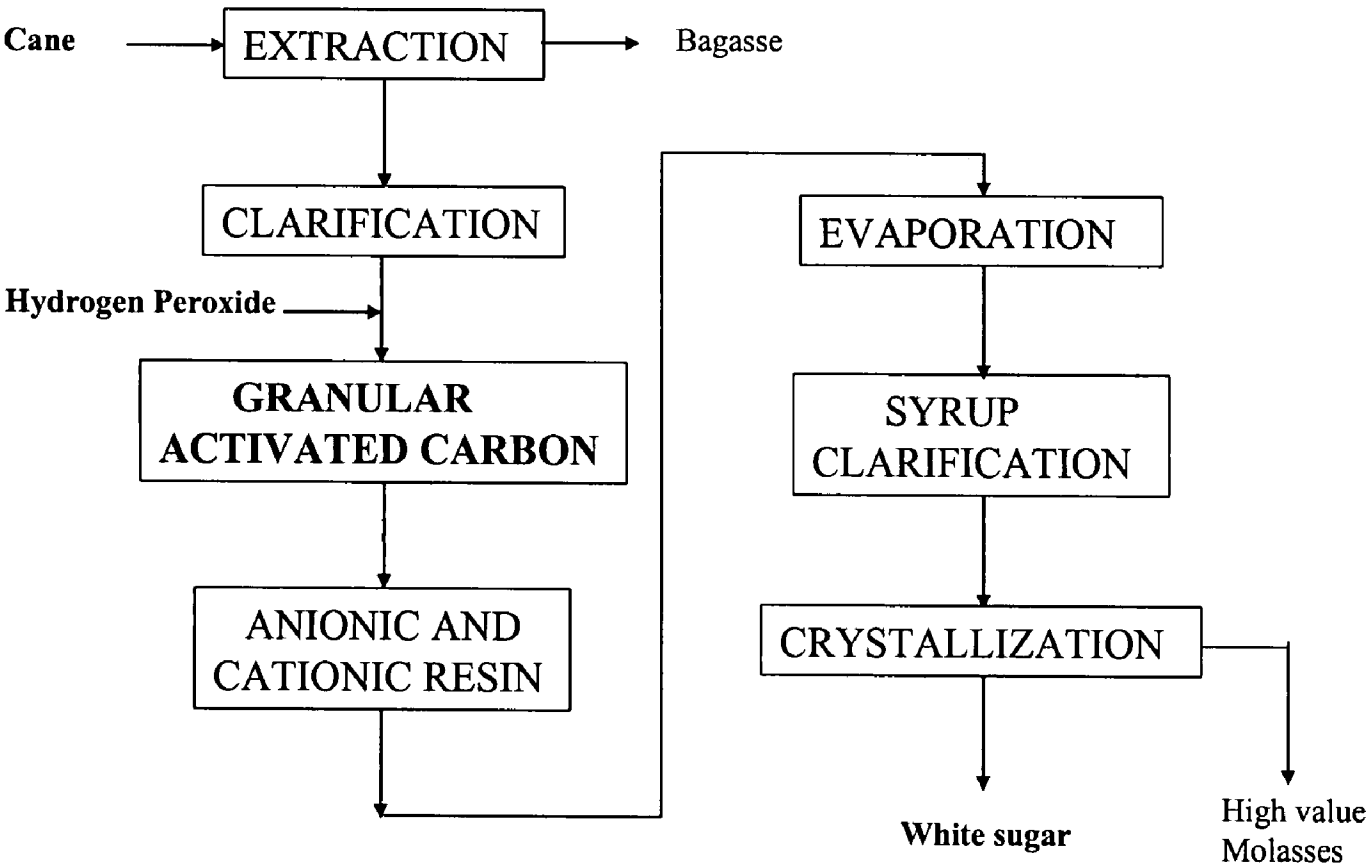
FIG. 2 illustrates schematically another embodiment of the invention, using hydrogen peroxide, GAC, and softening and decolorization to produce while sugar and high value molasses from sugar cane.

Briefly, the process depicted in FIG. 1 removes most of the inorganic species. The process in FIG. 2, on the other hand, replaces calcium and magnesium dissolved in the juice with sodium, thus reducing evaporator scaling, reducing the color, and helping make both the ash content and the color of the produced sugar acceptable.

Example

Raw cane juice produced at the St. James, La. mill from the milling tandem was subjected to otherwise conventional heating, pH adjustment, polyelectrolyte flocculation, and settling in two SRI-type juice clarifiers. The resulting clarified juice was treated with hydrogen peroxide at 90° C., at a proportion by weight of 0.1% of juice solids, before being passed through 17 liters of granular activated carbon (GAC) in a glass column. Analysis of clarified juice and decolorized juice are presented in the Table below. The quantity of juice and flows are given in units of Bed Volumes (BV) and BV/h, respectively.

| Cycle | Feed | | Clarified juice | | | Decolorized juice | | | |
|---|---|---|---|---|---|---|---|---|---|
| | | | | Color | | | Color | | Δ color |
| No. | BV | BV/h | Brix | (I.U.) | pH | Brix | (I.U.) | pH | (%) |
| 0 | — | 1 | 11.73 | 13,824 | 5.4 | 12.33 | 788 | 4.9 | 94.3 |
| 1 | 96 | 1 | 13.35 | 7,813 | 6.4 | 13.20 | 789 | 4.1 | 89.9 |

-continued

| Cycle | Feed | | Clarified juice | | | Decolorized juice | | | Δ color |
|---|---|---|---|---|---|---|---|---|---|
| | | | | Color | | | Color | | |
| No. | BV | BV/h | Brix | (I.U.) | pH | Brix | (I.U.) | pH | (%) |
| 2 | 120 | 1 | 13.72 | 10,840 | 7.9 | 13.43 | 1,838 | 6.1 | 83.0 |
| 3 | 120 | 1 | 14.18 | 21,059 | 8.7 | 13.34 | 2,423 | 4.5 | 88.5 |
| 4 | 168 | 1 | 14.14 | 12,252 | 8.6 | 13.85 | 2,426 | 5.6 | 80.2 |
| 5 | 144 | 1 | 14.06 | 14,034 | 8.6 | 13.34 | 2,583 | 4.5 | 81.6 |
| 6 | 216 | 1 | 14.51 | 14,128 | 8.4 | 14.74 | 5,382 | 5.9 | 61.9 |
| 7 | 120 | 1 | 12.15 | 17,465 | 8.4 | 11.20 | 6,436 | 5.3 | 63.1 |
| 8 | 120 | 1 | 13.62 | 12,148 | 8.0 | 13.11 | 1,418 | 5.0 | 88.3 |
| 9 | 288 | 2 | 12.84 | 7,123 | 7.5 | 12.23 | 3,356 | 5.9 | 52.9 |
| 10 | 432 | 2 | 13.31 | 8,011 | 6.9 | 12.73 | 3,956 | 4.3 | 50.6 |
| Mean | — | — | 13.42 | 12,609 | 7.7 | 13.04 | 2,854 | 5.1 | 77.4 |

White sugar may be directly crystallized from the decolorized juice, using crystallization techniques otherwise known in the art. The number of cycles of operation between regeneration of the carbon was varied to assess the sensitivity of operating parameters. In practice, the number of cycles between regenerations will be as needed to achieve the level of overall color removal desired. Typically, the ion exchange resins are regenerated when decolorization drops below about 40%.

As used in the specification and claims, the term "not irreversibly fouled" (or cognates) refers to a situation in which any fouling of the ion exchange resins that occurs may readily be reversed for at least about the first 50-100 cycles of use, preferably for at least about 200 cycles. It does not, however, preclude the possibility of the irreversible loss of ion exchange capacity over longer periods.

The complete disclosures of all references cited in this specification are hereby incorporated by reference. In the event of an otherwise irreconcilable conflict, however, the present specification shall control.

We claim:

1. A process for purifying clarified sugar cane juice or clarified sugar beet juice, wherein the juice contains color compounds, said process comprising the sequential steps of:

(a) first, mixing the juice with an oxidizing agent, wherein the oxidizing agent oxidizes some of the color compounds in the juice;

(b) second, passing the juice through granular activated carbon, wherein the carbon adsorbs some of the color compounds in the juice; and (c) third, passing the juice through cationic and anionic ion exchange resins, wherein the resins remove at least some inorganic ions from the juice, and wherein the resins adsorb some of the color compounds in the juice;

wherein, following said first, second, and third steps, the concentration of color compounds in the juice is reduced by at least 50%; and wherein, following said first, second, and third steps, the concentration of divalent cations in the juice is reduced by at least 75%.

2. A process as recited in claim 1, wherein the concentration of color compounds in the juice is reduced by at least 60%.

3. A process as recited in claim 1, wherein the concentration of color compounds in the juice is reduced by at least 70%.

4. A process as recited in claim 1, wherein the concentration of color compounds in the juice is reduced by at least 80%.

5. A process as recited in claim 1, wherein the concentration of color compounds in the juice is reduced by at least 90%.

6. A process as recited in claim 1, wherein the oxidizing agent comprises ozone.

7. A process as recited in claim 1, wherein the oxidizing agent comprises hydrogen peroxide.

8. A process as recited in claim 1, wherein the oxidizing agent comprises hydrogen peroxide at a concentration, by weight, between about 0.05% and about 0.5% of the weight of dissolved solids in the juice.

9. A process as recited in claim 1, wherein the oxidizing agent comprises hydrogen peroxide at a concentration, by weight, between about 0.1% and about 0.3% of the weight of dissolved solids in the juice.

10. A process as recited in claim 1, wherein the oxidizing agent comprises hydrogen peroxide at a concentration, by weight, between about 0.1% and about 0.3% of the weight of dissolved solids in the juice; wherein said process additionally comprises the step of holding the mixture of juice and hydrogen peroxide between about 5 and about 30 minutes, at a pH between about 6.0 and about 8.5, at a temperature between about 75° C. and about 99° C., prior to said second step.

11. A process as recited in claim 1, wherein said second step comprises passing the juice through two or more granular activated carbon columns in series, at a temperature between about 75° C. and about 99° C.

12. A process as recited in claim 1, wherein said third step comprises passing the juice at a temperature between about 8° C. and about 12° C. through a cationic resin in $H^+$ form, and through an anionic resin in $OH^-$ form, wherein the cationic resin and the anionic resin are in separate columns.

13. A process as recited in claim 1, wherein said third step comprises passing the juice at a temperature between about 8° C. and about 12° C. through a cationic resin in $H^+$ form, and through an anionic resin in $OH^-$ form, wherein the cationic resin and the anionic resin are both contained in a mixed bed.

14. A process as recited in claim 1, additionally comprising the step, following said third step, of evaporating water from the juice to form a syrup with a concentration of about 60 to about 68%, by mass, of soluble solids.

15. A process as recited in claim 14, additionally comprising the step, following said evaporating step, of clarifying the syrup.

16. A process as recited in claim 14, additionally comprising the step, following said evaporating step, of directly crystallizing white sugar from the syrup; wherein no substantial amount of a solid-phase raw sugar is present at any point during said process.

17. A process as recited in claim 14, wherein said crystallizing step produces white crystalline sucrose having a color less than or equal to about 45 IU.

18. A process as recited in claim 14, wherein said crystallizing step produces white crystalline sucrose having a color less than or equal to about 25 IU.

19. A process as recited in claim 1, wherein said process does not employ a carbonatation step, and wherein said process does not employ a phosphatation step.

20. A process as recited in claim 1, wherein said process does not employ a membrane filtration step.

21. A process as recited in claim 1, wherein:

(a) the oxidizing agent comprises hydrogen peroxide at a concentration, by weight, between about 0.1% and about 0.3% of the weight of dissolved solids in the juice; wherein said process additionally comprises the step of holding the mixture of juice and hydrogen peroxide between about 5 and about 30 minutes, at a pH between about 6.0 and about 8.5, at a temperature between about 75° C. and about 99° C., prior to said second step;

(b) said second step comprises passing the juice through two or more granular activated carbon columns in series, at a temperature between about 75° C. and about 99° C.;

(c) said third step comprises passing the juice at a temperature between about 8° C. and about 12° C. through a cationic resin in $H^+$ form, and through an anionic resin in $OH^-$ form, and wherein the concentration of color compounds in the juice after said third step is reduced by at least 80%.

22. A process as recited in claim 21, additionally comprising the steps, following said third step, of:

(a) evaporating water from the juice to form a syrup with a concentration of about 60 to about 68%, by mass, of soluble solids;

(b) clarifying the syrup; and (c) directly crystallizing white sugar from the syrup; wherein no substantial amount of a solid-phase raw sugar is present at any point during said process; and wherein the white sugar comprises white crystalline sucrose having a color less than or equal to about 25 IU.

23. A process as recited in claim 22, wherein said process does not employ a carbonatation step, and wherein said process does not employ a phosphatation step, and wherein said process does not employ a membrane filtration step.

24. A process as recited in claim 1, wherein the ion exchange resins are not irreversibly fouled during said third step; and wherein said process additionally comprises the step of regenerating the ion exchange resins.

* * * * *